US007316781B2

(12) United States Patent
Radomyselski et al.

(10) Patent No.: US 7,316,781 B2
(45) Date of Patent: Jan. 8, 2008

(54) PSEUDO-DISTILLATION METHOD FOR PURIFYING A DRY CLEANING SOLVENT

(75) Inventors: Arseni Valerevich Radomyselski, Loveland, OH (US); Mark Robert Sivik, Mason, OH (US); Victor Manuel Arredondo, West Chester, OH (US); William Michael Scheper, Guilford, IN (US); John Christian Haught, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 472 days.

(21) Appl. No.: 10/876,059

(22) Filed: Jun. 24, 2004

(65) Prior Publication Data

US 2004/0262570 A1 Dec. 30, 2004

Related U.S. Application Data

(60) Provisional application No. 60/483,315, filed on Jun. 27, 2003.

(51) Int. Cl.
*B01D 1/22* (2006.01)

(52) U.S. Cl. ..... 210/631; 159/47.1; 159/49; 210/774; 210/806; 203/89

(58) Field of Classification Search ..... 210/639, 210/644, 774, 804, 806, 631, 632, 634; 8/142, 8/115.7; 134/10, 12; 68/18, 19; 159/47.1, 159/49; 203/39, 89
See application file for complete search history.

(56) References Cited

U.S. PATENT DOCUMENTS

| | | | | |
|---|---|---|---|---|
| 3,619,116 | A | 11/1971 | Saville | |
| 3,775,053 | A | 11/1973 | Wisdom | |
| 2004/0148708 | A1 * | 8/2004 | Stoessel et al. | 8/115.51 |

FOREIGN PATENT DOCUMENTS

| | | |
|---|---|---|
| EP | 0 340 482 | 8/1989 |
| GB | 989788 | 4/1965 |

* cited by examiner

*Primary Examiner*—Joseph Drodge
(74) *Attorney, Agent, or Firm*—Kim William Zerby; Steven W. Miller

(57) ABSTRACT

Pseudo-distillation, steady-state method for purifying dry cleaning solvents containing laundry soils and other contaminants.

5 Claims, No Drawings

PSEUDO-DISTILLATION METHOD FOR PURIFYING A DRY CLEANING SOLVENT

CROSS REFERENCE TO RELATED APPLICATIONS

This application claims the benefit of U.S. Provisional Application Ser. No. 60/483,315 filed on Jun. 27, 2003.

FIELD OF THE INVENTION

The present invention relates to a pseudo-distillation, steady-state method of purifying used dry cleaning solvents containing laundry soils and other contaminants.

BACKGROUND OF THE INVENTION

Conventional laundering techniques for cleaning and refreshing (e.g., removing malodors) fabric articles can be generally categorized into the aqueous-based washing technique and the "dry cleaning" technique. The former involves immersion of the fabric article in a solution comprising primarily of water; detergent or soap may be added to enhance the cleaning function. The latter typically involves the use of non-aqueous fluids as the agent for cleaning and refreshing.

Cleaning solvents, after being used in a laundering treatment, typically comprise contaminants, such as dyes, water and/or surfactants. Since the dry cleaning solvents are more expensive than water, there is a need to recycle/reuse the dry cleaning solvents in more than one treatment.

Conventional dry cleaning solvents are subjected to a distillation method to remove some contaminants. Representative systems using the distillation method are disclosed in EP 543,665 and U.S. Pat. Nos. 5,942,007; 6,056,789; 6,059,845; and 6,086,635. However, equipment and conditions to run the distillation are extremely burdensome as well as energy consuming. Among the drawbacks of the distillation method are the high cost of the distillation unit, the daily manual intervention required to clean the still bottom, and its ineffectiveness in removing volatile contamninants. Accordingly, there is a need to remove contaminants from dry cleaning solvents without distillation.

There have been other methods to remove contaminants from dry cleaning solvents without distillation. Typically, these non-distillation methods use filtration only systems with adsorbent materials, such as activated carbons and/or clay. For example, the commonly used, commercially available KleenRite® filter is made of a clay absorbent and an activated carbon adsorbent. Representative filters containing carbon and clay adsorbent materials are disclosed in U.S. Pat. Nos. 4,277,336 and 3,658,459. However, such filter has a rather limited lifetime due to the high percentage of clay absorbent in the filter. The clay absorbent has a finite capacity for absorbing contaminants, such as water, and once that capacity is met, the filter must be replaced with a new filter. In addition to the limitations around the clay absorbent, the activated carbon adsorbent has limitations also. The particle size and/or pore size of the activated carbon adsorbent material allows some contaminants to flow past the activated carbon adsorbent material, thus making the filter ineffective. Further, in conventional use, the used, contaminated dry cleaning solvent is pumped through the filter at a rate that does not allow the clay absorbent and/or activated carbon adsorbent to remove contaminants effectively. This is especially true for those contaminants that are highly soluble in the dry cleaning solvent. Additionally, some of the solvents are lost due to the frequent changes of the filters.

Therefore, there is a need for a method that effectively removes contaminants from a dry cleaning solvent such that the purified solvent can be recycled/reused.

It is also desirable to have a method capable of purifying a dry cleaning solvent in an economical and energy efficient manner.

Additionally, it is desirable that the purification method is safe and durable. The purification system or unit must have a lifetime of at least 25 cycles before operator intervention and/or changing of components become necessary.

Therefore, there is a need for a purification method that removes soluble contaminants from the dry cleaning solvent.

SUMMARY OF THE INVENTION

The present invention relates to a purification process for removing contaminants from a lipophilic fluid comprising the steps of:

(a) providing a mixture comprising a lipophilic fluid and at least one contaminant;
(b) converting the mixture into a high surface area fluid;
(c) vaporizing at least the lipophilic fluid in the high surface area fluid from a vaporizing surface, thereby separating the contaminant from the lipophilic fluid and converting the lipophilic fluid into a purified lipophilic fluid; and
(d) collecting the purified lipophilic fluid on a condensing surface;

wherein vaporization process of step (c) is at a steady-state condition.

DETAILED DESCRIPTION

Definitions

The term "fabric article" as used herein means any article that is customarily cleaned in a conventional laundry process or in a cleaning process. As such the term encompasses articles of clothing, linen, drapery, and clothing accessories. The term also encompasses other items made in whole or in part of fabric, such as tote bags, furniture covers, tarpaulins and the like.

The term "absorbent material" or "absorbent polymer" as used herein means any material capable of selectively ingesting (i.e., absorbing or adsorbing) water and/or water-containing liquids without ingesting dry cleaning solvents. In other words, absorbent materials or absorbent polymers comprise a water absorbing agent, which is referred to in the art as "gel", "polymeric gel" and "super absorbent polymers".

The term "cleaning composition" as used herein means any dry cleaning solvent-containing composition that comes into direct contact with fabric articles to be cleaned. It should be understood that the composition can have uses other than cleaning, such as conditioning, sizing, and other fabric care treatments. Thus, it may be used interchangeably with the term "treating composition". Furthermore, optional cleaning adjuncts such as additional detersive surfactants, bleaches, perfumes, and the like may be added to the "cleaning composition". That is, cleaning adjuncts may be optionally combined with the dry cleaning solvent. These optional cleaning adjuncts are described in more detail herein below.

The term "dry cleaning" or "non-aqueous cleaning" as used herein means a non-aqueous fluid is used as the dry cleaning solvent to clean a fabric article. However, water can be added to the "dry cleaning" method as an adjunct cleaning agent. The amount of water can comprise up to about 25% by weight of the dry cleaning solvent or the cleaning composition in a "dry cleaning" process. The non-aqueous fluid is referred to as the "lipophilic fluid" or "dry cleaning solvent".

The terms "soil" or "laundry soil" as used herein mean any undesirable extraneous substance on a fabric article that is the target for removal by a cleaning process. By the terms "water-based" or "hydrophilic" soils, it is meant that the soil comprised water at the time it first came in contact with the fabric article, or the soil retains a certain amount of water on the fabric article. Examples of water-based soils include, but are not limited to beverages, many food soils, water soluble dyes, bodily fluids such as sweat, urine or blood, outdoor soils such as grass stains and mud. On the other hand, the term "lipophilic" soils, as used herein means the soil has high solubility in or affinity for the lipophilic fluid. Examples of lipophilic soils include, but are not limited to body soils, such as mono-, di-, and tri-glycerides, saturated and unsaturated fatty acids, non-polar hydrocarbons, waxes and wax esters, lipids; and laundry materials such as non-ionic surfactants; and mixtures thereof.

As used herein, the term "insoluble" means that a material will physically separate (i.e. settle-out, flocculate, float) from the liquid medium (a dry cleaning solvent or water) within 5 minutes after being added to the liquid medium, whereas the term "soluble" means that a material does not physically separate from the liquid medium within 5 minutes after addition.

Lipophilic Fluid

"Lipophilic fluid" as used herein means any liquid or mixture of liquid that is immniscible with water at up to 20% by weight of water. In general, a suitable lipophilic fluid can be fully liquid at ambient temperature and pressure, can be an easily melted solid, e.g., one that becomes liquid at temperatures in the range from about 0° C. to about 60° C., or can comprise a mixture of liquid and vapor phases at ambient temperatures and pressures, e.g., at 25° C. and 1 atm. pressure.

It is preferred that the lipophilic fluid herein be non-flammable or, have relatively high flash points and/or low VOC characteristics, these terms having conventional meanings as used in the dry cleaning industry, to equal or, preferably, exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes selected from the group consisting of octamethyl-cyclotetrasiloxane (tetramer), dodecamethyl-cyclohexasiloxane (hexamer), and preferably decamethyl-cyclopentasiloxane (pentamer, commonly referred to as "D5"). A preferred siloxane comprises more than about 50% cyclic siloxane pentamer, more preferably more than about 75% cyclic siloxane pentamer, most preferably at least about 90% of the cyclic siloxane pentamer. Also preferred for use herein are siloxanes that are a mixture of cyclic siloxanes having at least about 90% (preferably at least about 95%) pentamer and less than about 10% (preferably less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of glycerine derivative solvents include materials having the following structure:

Non-limiting examples of suitable glycerine derivative solvents for use in the methods and/or apparatuses of the present invention include glyercine derivatives having the following structure:

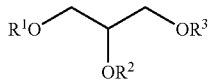

Structure I wherein $R^1$, $R^2$ and $R^3$ are each independently selected from: H; branched or linear, substituted or unsubstituted $C_1$-$C_{30}$ alkyl, $C_2$-$C_{30}$ alkenyl, $C_1$-$C_{30}$ alkoxycarbonyl, $C_3$-$C_{30}$ alkyleneoxyalkyl, $C_1$-$C_{30}$ acyloxy, $C_7$-$C_{30}$ alkylenearyl; $C_4$-$C_{30}$ cycloalkyl; $C_6$-$C_{30}$ aryl; and mixtures thereof. Two or more of $R^1$, $R^2$ and $R^3$ together can form a $C_3$-$C_8$ aromatic or non-aromatic, heterocyclic or non-heterocyclic ring.

Non-limiting examples of suitable glycerine derivative solvents include 2,3-bis(1,1-dimethylethoxy)-1-propanol; 2,3-dimethoxy-1-propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone formation potential of from about 0 to about 0.31, lipophilic fluids that have a vapor pressure of from about 0 to about 0.1 mm Hg, and/or lipophilic fluids that have a vapor pressure of greater than 0.1 mm Hg, but have an ozone formation potential of from about 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

"Ozone Reactivity" as used herein is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Page 881-899, 1994. "Vapor Pressure" as used can be measured by techniques defined in Method 310 of the California Air Resources Board.

Preferably, the lipophilic fluid comprises more than 50% by weight of the lipophilic fluid of cyclopentasiloxanes, ("D5") and/or linear analogs having approximately similar volatility, and optionally complemented by other silicone solvents.

The level of lipophilic fluid, when present in the treating compositions according to the present invention, is preferably from about 70% to about 99.99%, more preferably from about 90% to about 99.9%, and even more preferably from about 95% to about 99.8% by weight of the treating composition.

Fabric Care Composition

The fabric care composition of the present invention comprises a lipophilic fluid, a detersive surfactant, and optionally, water and/or cleaning adjuncts.

The detersive surfactant component, when present in the fabric care compositions of the present invention, preferably comprises from about 1% to about 99%, more preferably 2% to about 75%, even more preferably from about 5% to about 60% by weight of the composition.

The composition may optionally comprise a polar solvent, e.g., water, ranging from about 99% to about 1%, preferably from about 5% to about 40%, by weight of the composition; and cleaning adjuncts ranging from about 0.01% to about 50%, preferably from about 5% to about 30%, by weight of the composition When the composition is diluted with a lipophilic fluid to prepare the wash liquor, the fabric care composition comprises from about 0.1% to about 50%, more preferably from about 1% to about 30%, even more preferably from about 2% to about 10% by weight of the wash liquor. Moreover, the amount of the above detersive surfactant in the wash liquor is in the range from about 0.001% to about 50%, preferably from about 1% to about 40%, and more preferably from about 2% to about 30% by weight of the wash liquor.

In some embodiments, water may optionally be incorporated into the wash liquor as well. Water may be added as a component of the fabric care composition or as a co-solvent of the lipophilic fluid.

Contaminants

The contaminants that may enter the dry cleaning solvent during fabric article treating processes typically include laundry soils, especially lipophilic laundry soils, such as nonionic surfactants, saturated and unsaturated fatty acids, mono-, di- and tri-glycerides, non-polar hydrocarbons, waxes and wax esters, lipids, and mixtures thereof.

The contaminants may also come from the fabric treating composition, including: nonionic surfactants, water, dyes, auxiliary cleaning agents or other cleaning adjuncts. Non-limiting examples of various cleaning adjuncts include: cationic, anionic or zwitterionic surfactants, detergent components which did not adhere to the fabric, enzymes, bleaches, fabric softeners, perfumes, antibacterial agents, antistatic agents, brighteners, dye fixatives, dye abrasion inhibitors, anti-crocking agents, wrinkle reduction agents, wrinkle resistance agents, soil release polymers, sunscreen agents, anti-fade agents, builders, sudsing agents, composition malodor control agents, composition coloring agents, pH buffers, waterproofing agents, soil repellency agents, and mixtures thereof.

Method

During the fabric article treating process, the dry cleaning solvent and/or composition typically become contaminated with contaminants, such as those disclosed above. The present invention is directed to a method for removing contaminants from a used, contaminated dry cleaning solvent by first converting a mixture comprising the dry cleaning solvent and contaminants into a high surface area fluid, such as droplets or thin films. Then, the dry cleaning solvent molecules are vaporized, thereby separating some low volatility, low solubility contaminants from the dry cleaning solvent.

As used herein, the term "droplets" differ from the term "vapors". It is intended that droplets of fluid have an average particle size in the micron range. In contrast, vapors are made of molecules of liquid and typically have an average particle size in the submicron range. Droplets are capable of carrying soils or contaminants, especially those soils or contaminants that are highly soluble in the dry cleaning solvent. Vapors are primarily molecules of the dry cleaning solvent, thus, are free of extraneous compounds, such as soils or contaminants.

The dry cleaning solvent thus purified can be used as working solvent in subsequent fabric article cleaning cycles. It is recognized that the methods of the present invention can also be applied to purify or recycle dry cleaning composition, which may comprise an emulsion of a dry cleaning solvent, water and various contaminants.

A pseudo-distillation device suitable for use herein will remove sufficient contaminants from the dry cleaning solvent or composition such that the level of contaminants in the purified solvent or composition does not impair its performance when it is used as the working solvent or reformulated (by replacing the cleaning adjuncts that may have been removed in the process) as the working composition in subsequent fabric article treating processes.

The removal of contaminants in the purification process of the present invention should result in a reduction in contaminant concentration of at least about 10%, preferably at least about 25%, more preferably at least about 50%. A reduction is contaminant concentration of about 50% to about 100% is highly desirable. Such results can be achieved with the type of contaminant that is a solid, particulate material; has a high boiling temperature (e.g., at least about 50 C higher than the boiling temperature of the dry cleaning solvent); is an insoluble liquid in the dry cleaning solvent; or combinations thereof. The percentage of contaminants removed from the lipophilic fluid can determined by Thin Layer Chromatography (TLC) disclosed in the Test Method Section. If the contaminant is water, the water content in a fluid can be determined by the Karl-Fischer Titration Method according to ASTM E1064-00.

The type of fabric articles, type of contaminant are factors that influence the level of contaminants that may remain in the purified solvent or composition without impairing its cleaning performance. That is, the purified solvent or composition may comprise a higher level of one type of contaminant than another. For example, the level of dyes may be present from about 0.0001% to about 0.1%, preferably from about 0.00001% to about 0.1%, and more preferably from about 0% to about 0.001% by weight of the working solvent. On the other hand, the level of water in the purified solvent may be from about 0.001% to about 20%, preferably from about 0.0001% to about 5 % and more preferably from about 0% to about 1%.

The method of the present invention preferentially separate lipophilic contaminants having a Hilderbrand solubility parameter of the lipophilic contaminant and a Hilderbrand solubility parameter of the lipophilic fluid differ by at least about 5 $MPa^{1/2}$, preferably at least about 4 $MPa^{1/2}$, and more preferably at least about 3 $MPa^{1/2}$. The lipophilic contaminants include, but are not limited to nonionic surfactants, saturated and unsaturated fatty acids, mono-, di- and triglycerides, non-polar hydrocarbons, and mixtures thereof.

The method of the present invention preferentially separate non-volatile contaminants having a boiling temperature that contaminant is a non-volatile contaminant having a boiling temperature at 1 atm pressure that is at least about 50° C. higher, preferably at least about 80° C. higher, than the boiling temperature at 1 atm pressure of the lipophilic fluid, or solid contaminants having no boiling temperature.

In one aspect of the invention, the purified dry cleaning solvent or composition can be collected and/or reformulated and can be re-used immediately as the working solvent in several additional fabric cleaning cycles before they need to be purified with the pseudo-distillation method of the present invention. In another aspect of the invention, the purified dry cleaning solvent or composition can be removed from the cleaning system, stored and used later as the working solvent or composition in another system or another fabric cleaning cycle.

It is worth noting that the method of the present invention is carried out in a low pressure condition. On one hand, there is no over-boiling of solvent generated during the purification process of the present invention. In contrast, the distillation operation used by commercial dry cleaners to purify the dry cleaning solvent tends to produce excessive foaming in the presence of some common contaminants such as water, surfactants, or a mixture thereof. Foaming and/or over-boiling increases the possibility of leakage of solvent vapors outside the purification unit.

On the other hand, the method of the present invention makes more efficient use of energy than the commercial distillation operation since purification of solvent is done under low temperature and low pressure conditions. In a typical example, the energy consumption of the present purification method is less than about 0.05 kW-hr, preferably less than about 0.03 kW-hr, and more preferably less than about 0.01 kW-hr, per liter of lipophilic fluid processed.

Furthermore, because of the low pressure, low foaming conditions of the present method, the valves, joints, and the like, of the purification unit can be leak-proofed easily, whereas the commercial distillation unit requires cumbersome contraption to leak-proof it.

In view of the above advantages, the method of the present invention uniquely provides a safe and economic way or purifying the mixture of a lipophilic fluid and contaminant, thus, is particularly suitable for residential dry cleaning applications in consumer's home.

Further, the pseudo-distillation method of the present invention may be employed to purify the solvent or composition via an integral (i.e., in-line) component of the cleaning system or an accessory (post cleaning cycle) component of the cleaning system.

a. Providing Mixtures of Lipophilic Fluid and Contaminants

The method comprises a first step of providing a mixture of a lipophilic fluid and at least one contaminant. The mixture may be generated by exposing a fabric article to a lipophilic fluid or a cleaning composition comprising dry cleaning solvent and other cleaning adjuncts such as water or surfactants. Alternatively, water may be applied from a separate source to the fabric article in this cleaning step. Then, the used and/or contaminated lipophilic fluid or cleaning composition, typically in the form of the lipophilic fluid and water emulsion, can be collected and used as the mixture needing purification in the present method.

The cleaning methods to provide the contaminated mixture include conventional immersive cleaning methods as well as the non-immersive cleaning methods disclosed in U.S. patent applications U.S. 20020133886A1 and U.S. 20020133885A1.

b. Generating High Surface Area Fluids

For the method of the present invention to work effectively, the high surface area droplets or films should have a surface to volume ratio of from about 1000:1 to about 4:1, preferably from about 500:1 to 10:1, and more preferably from about 200:1 to about 20:1.

Not wishing to be bound by theory, it is believed that by spreading out the mixture of lipophilic fluid and contaminants and gently vaporize the thin films or droplets would allow the solvent molecules to break free from the surface of fluid and the contaminants therein, thereby minimizes the carry-over or entrapment of contaminants in the solvent vapors and improves the efficiency of the purification process.

In some embodiments, the high surface area fluid is in the form of droplets, preferably suspended in air to form a fine mist or an aerosol. The average particle size of the droplets should be from about 0.1 microns to about 200 microns. If the average particle size is too large, the droplets may not be able to maintain the suspended state, and revert back to the bulk fluid form. On the other hand, if the droplets are too small, they are prone to move in a randomized manner and are less responsive to the forces or gradients used to direct the movement of the droplets such that some of the droplets may move towards the bulk fluid, thereby reducing the efficiency of the purification process.

In one embodiment, the contaminated mixture is dispensed by spraying, pumping, suction, or combinations thereof, thereby the contaminated mixture is converted into a fine mist of droplets or aerosols. It is preferred that suitable nozzles be used such that the resulting droplets have an average particle size of less than about 200 μm, preferably less than about 120 μm and more preferably less than about 80 μm.

In another embodiment, the contaminated mixture may be converted into a fine mist using a nebulizer that has at least one ultrasonic sonotrode, or ultrasonic vibrating cell. The fine mist thus produced comprises small droplets of liquid with an average particle size preferably within the range of about 1 to about 35 μm, more preferably of about 1 to about 20 μm. Such nebulizer is commercially available from Sono Tek Corporation, Milton, N.Y., under the trade name Acu Mist® or from the Omron Health Care, GmbH, Germany; or Flaem Nuove, S. P. A, Italy.

There are several means or devices to convert a fluid into fine droplets of fluid, including rotary atomizers, centrifugal or spinning disk atomizers, pressure atomizers, pneumatic or gas-assisted atomizers, ultrasonic atomizers, electrostatic atomizers, and combinations thereof.

A rotary atomizer impinges a liquid onto a rapidly rotating surface; the rotational energy transmitted to the liquid causes the liquid to leave the atomizer with a high kinetic energy and break apart. Similarly, in centrifugal or spinning disk atomization, liquid feed is accelerated to a velocity in excess of about 300 ft/sec to produce fine droplets. Particle size can be controlled by wheel speed, feed rate, liquid properties and atomizer design. There are no vibrations, little noise and small risk of clogging. Furthermore, the system operates with low power consumption and provides feed-rate capacities in excess of about 200 tons/hr.

A pressure atomization method uses very high pressure to force the liquid through a nozzle having a small orifice. The pressure applied to the fluid is converted into kinetic energy to force the breakup of the liquid. There are several variations to this general method. One variation uses a jet atomizer, which produces jets that break apart as they leave the atomizer; this atomizer requires high injection pressures. Another variation uses a swirl atomizer, which swirls a liquid inside an atomizer to form a conical sheet of fluid that breaks up more easily than a jet of fluid; this atomizer requires lower pressures. In yet another variation, the jet and swirl atomization methods are combined into one atomizer.

A pneumatic or gas-assist atomization method uses the energy of a carrier gas to break up sheets or jets of a liquid. It is a common practice to also introduce, in a transverse direction, a liquid stream into a high-velocity gas stream. This atomization method may not be combined with vacuum distillation or other techniques where vacuum is introduced, since it would introduce air/gas into vacuum chamber.

An ultrasonic atomizer uses an ultrasonic transducer or horn that vibrates at ultrasonic frequencies (typically 50 kHz to 2.4 MHz) to produce the short wavelengths required for liquid atomization. When a liquid comes into contact with an ultrasonically driven surface, a wave pattern appears on the surface of the liquid. When the amplitude of the vibration is sufficient, the wave height is sufficient for the wave crests in the liquid surface to become unstable. This instability drives the formation of droplets that are ejected from the surface. In general, the drops produced by ultrasonic atomization have a relatively narrow size distribution. Median drop sizes range from 18-68 microns, depending on the operating frequency of the specific type of nozzle. As an example, for a nozzle with a median drop size diameter of approximately 40 microns, 99.9% of the drops will fall in the 5-200 micron diameter range. The flow rate range for the entire family of ultrasonic nozzles is from as low as a few microliters per second to up to about 6 gallons per hour.

Depending on the specific nozzle and the type of liquid delivery system employed (gear pump, syringe pump, pressurized reservoir, peristaltic pump, gravity feed, etc.), the technology is capable of providing an extraordinary variety of flow/spray possibilities.

An electrostatic atomizer uses electrostatic force to break up liquids. When a liquid stream comes into contact with an electron source, charge transfer to liquid can occur. The repulsion between charges on the liquid causes the liquid stream to disintegrate into fine droplets. This method is quite flexible since the size of the charged droplets can be easily manipulated by adjusting the electric fields. This manipulation would provide droplets of an average size sufficiently large to overcome the thermophoretic effect such that the droplets can be deposited onto relatively high temperature surfaces, yet small enough to maintain the droplets in the suspended state.

In other embodiments, the high surface area fluid is in the form of thin films having a thickness of from about 0.1 to about 1000 microns, preferably from about 1 to about 100 microns. Thin films of fluid can be created by feeding and spreading the fluid over a surface, preferably in a continuous feed. The falling film method is a continuous operation wherein the quality of the film is affected by the feed material's viscosity, density, feed rate, and combinations thereof. The wiped film method is similar to the falling film method, except that the feed is spread mechanically by rotating wiper elements.

c. Vaporizing via Pseudo-Distillation

The vaporization of the lipophilic fluid from the high surface area fluid can be accomplished by pseudo-distillation. As used herein, the term "pseudo-distillation" refers to a vaporization process that converts a fluid to its vapor form at low temperature and low pressure conditions. In one aspect of the invention, the pressure in the device/system is maintained at less than about 500 Torrs, preferably less than about 100 Torrs , and most preferably at about 1 Torr during the entire pseudo-distillation process. In another aspect of the invention, the pressure in the device/system is maintained at steady state pressure condition by matching the pumping rate of vacuum pump to the evaporation rate of the solvent. In such arrangement, a well controlled solvent evaporation is achieved where injected solvent surface area and solvent flow rate into the evaporation chamber remains constant.

In a typical embodiment, the temperature of the pseudo-distillation is less than about 150° C., preferably less than about 100° C. and more preferably less than about 60° C.

Heat can be provided by any conventional heating means, such as steam, heating tape, heating fluid, and the like. These heating means can be applied to the vaporizing surface, and to a less extent, the space between the vaporizing surface and the collecting surface via radiation and convection. In other embodiments, the heating means is a radiation heating device, which delivers radiation energy in the infrared or microwave range.

Since evaporation is an endothermic process, as the solvent molecules leave the surface layer of a droplet or a film, the droplet or the film loses heat, which would lead to a decrease in droplet/film temperature, and would slow or prevent further evaporation of solvent molecules. Radiation heating means can provide penetrating and evenly distributed energy to the to the high surface area droplets or films inside the purification chamber and would sustain the evaporation process quite effectively.

Each droplet can be considered as a mini distillation unit. As the solvent molecule evaporates from the droplet surface, the contaminants in the droplet concentrate. Eventually the droplet becomes so concentrated in non-volatile or high boiling contaminants such that the distillation process cease and the remains of the droplet drop out of flight and is collected at the bottom of the unit. The distillation residue can be further purified using auxiliary technique disclosed herein. In some embodiments, the distillation residue can be separated by filtration into solid and fluid wastes, which can be disposed of separately Several external factors and/or gradients can be applied to the purification system to create a pseudo-distillation condition, such as vacuum, providing a temperature gradient, indirect and gentle heating, and combinations thereof.

For example, the thin film/evaporation method employs a continuous operation wherein the feed flows downward along the heated walls of the device (for example, a column). The quality of the film depends primarily on the feed material viscosity, density and feed rate. These factors influence the surface effects that the film experiences, which influences the quality of the separation of lipophilic fluid and contaminants. The product from this system is condensed on an external condenser, which is kept at a temperature lower than the evaporation surface (i.e., the heated wall). The advantages of this type of unit are its relatively simple design and its high throughput per unit size.

In one embodiment of the thin film/evaporation method, the temperature differential between the evaporation surface and the condensing surface should be at least about 10° C., preferably at least about 50° C., and more preferably at least about 80° C. Optionally, a gentle vacuum of about 500 Torrs, preferably about 100 Torrs, and more preferably about 50 Torrs, can be applied to the purification system; the vacuum pump should be able to pull sufficient vapor out of the purification chamber at a rate that matches the evaporation rate of the solvent at a specified temperature such that a steady state condition is established in the evaporation process and to effectuate separation of the solvent form the contaminants. However, as the thin film flows down the sidewalls of the device, a laminar flow may be established wherein the fluids in the laminar flow are not exposed to the heated walls homogeneously, and "hot spots" may be created.

In another embodiment, the wipe-film evaporator can be used to overcome this limitation of the falling-film design. The feed enters onto a heated wall from the top, but is spread mechanically by rotating wiper elements. The vapors produced flow counter-currently up past the wiper blades to an external condenser. This results in increased separation efficiency compared to that of a falling-film unit. They have a high throughput per unit size since they can operate continuously. They can handle materials with viscosities of up to 3000 cP (centipoises).

In still another embodiment, the atomized droplets can be vaporized by conventional heating means. Alternatively, under vacuum, the atomized droplets can be vaporized at a temperature significantly lower than the boiling temperature (at 1 atm) of the lipophilic fluid. For example, decamethylcyclopentasiloxane (D5) has a boiling temperature (at 1 atm) of 205° C., but under a vacuum of about 1 Torr, the atomized droplets of D5 can become saturated vapors at a temperature of about 60° C. or lower.

d. Collecting the Purified Lipophilic Fluid

The vaporized lipophilic fluid molecules are substantially free of the contaminants, and can be collected by condensation onto a cooled surface and flow down (for example, by gravity) into a container. There should be a physical separation (e.g., a gap) between the vaporizing surface and the collecting/condensing surface such that only vapors of the lipophilic fluid can fly across the gap. Thus, the purified lipophilic fluid is collected on the condensing surface and the mixture of contaminants are collected on the vaporizing surface. A temperature gradient, an electric field, a centrifugal field, and the like can be established between the vaporizing surface and the collecting surface to draw the lipophilic fluid vapors towards to the condensing surface, thus, enhances the efficiency of the separation process.

If necessary, the collected lipophilic fluid can be further treated with one of the auxiliary treating methods below to remove any residual contaminants therein and improves its purity. A preferred post-treatment is exposing the collected lipophilic fluid to activated carbons.

Auxiliary Treating Methods

The purification method of the present invention may further comprise auxiliary treating methods, before and/or after the evaporation step, to improve the separation between the lipophilic fluids and certain types of contaminants.

In one example, an air stripping method is applied to the mixture of lipophilic fluid and contaminants. The air stripping method bubbles air through the mixture, thereby volatile contaminants can be preferentially removed from the lipophilic fluid. This method is applicable to contaminants that have a low solubility in water or a high volatility relative to water. This method is beneficial in view of the fact that pseudo-distillation/vaporization may not be as effective in removing volatile contaminants.

In another example, a steam stripping method is applied to the mixture of lipophilic fluid and contaminants. The steam stripping method bubbles water vapor through the mixture, thereby hydrophilic contaminants can be preferentially removed from the lipophilic fluid.

In yet another example, a liquid-liquid extraction method is applied to the mixture of lipophilic fluid and contaminants. Extraction is the selective transfer of a compound or compounds from one liquid to another immiscible liquid or from a solid to a liquid. The former process is called a liquid-liquid extraction, wherein a foreign substance, such as an immiscible liquid, is introduced to provide a second phase, to which the compounds (or in the present case, the contaminants) can preferentially migrate. The driving force is based on the partition coefficient of the solute compound (s) in the respective liquids. In this separation technique, the compounds in the two liquid phases are merely separated by an interface (i.e., a chemical barrier), not by a physical barrier.

Extracting fluids suitable for use herein to create a second phase from the dry cleaning solvents include, but are not limited to, of water; linear or branched, cyclic or acyclic alcohols; linear or branched, cyclic or acyclic diols; and mixtures thereof.

In still another example, a filtration method is applied to the mixture of lipophilic fluid and contaminants. The mixture passes through a particulate filter to remove solid or insoluble contaminants from the mixture. Other density or gravity based separation methods can also be used to remove solids or insoluble contaminants. Examples of these methods include precipitation, sedimentation, centrifugation, decantation, and combinations thereof. Removal of solids and particulates from the mixture can improve the quality of the thin films or the droplets (i.e., they are more homogeneous) and enhance the separation of contaminants from the lipophilic fluid.

In an additional example, chemical modification of the contaminants can be applied to the mixture of lipophilic fluid and contaminants. Chemical modification involves the addition of chemicals to change at least one physico-chemical property of the contaminants, such as pH, ionic strength, etceteras. Examples of these chemicals include salts, acids, bases, coagulants, and flocculants. In one specific example, the chemical modification agents can contain cationic agents e.g., the alkaline earth metal ions or transitional metal ions, preferably in their magnetizable form. The contaminants may bind with the cations and becomes insoluble in the lipophilic fluid, thus, can be easily removed by filtration, osmosis, decantation, centrifugation, and the like. A magnetic field can be used to remove the modified contaminants (i.e., precipitants) from the solvent.

Other methods can also be used as the auxiliary treating step, which can be included in the purification method of the present invention as a pre-treating step or a post-treating step. The auxiliary treating step serve to enhance the purity of the recovered, purified lipophilic fluid. Nonlimiting examples of these auxiliary methods are described below.

Enzyme, microbial, or bacterial addition involves the addition of enzymes, microbes, or bacteria to the mixture to remove organic contaminants from the lipophilic fluid.

Dialysis is the transfer of solute through a membrane as a result of a concentration of the solute across the membrane. Osmosis operates under the same general principles as dialysis, except that the concentration gradient drives a solute transfer in dialysis but a solvent transfer in osmosis. Dialysis is effective in the removal of low molecular weight solute molecules or ions from a solution via their passage through a semi-permeable membrane driven by a concentration gradient.

Temperature modification enhances the separation of binary mixtures and can include both cooling and/or heating of the mixture. Increasing the temperature of the mixtures aids coalescence while cooling aids the crystallization or freezing of one of the components.

Electrostatic coalescence involves exposing an emulsion containing two mutually insoluble phases (for example lipophilic fluid and water), wherein one phase is the continuous phase and the other is the discontinuous phase, to an electric field to affect coalescence of the discontinuous phase into droplets of a large enough size such that the droplets gravitate from the emulsion based on the density difference of the two phases. In order to carry this method out, the two phases must have at least a minor difference in dielectric constants and densities. Electric coalescence is a well-known process and is described in U.S. Pat. No. 3,207,686 to Jarvis et al.; U.S. Pat. No. 3,342,720 to Turner; U.S. Pat. No. 3,772,180 to Prestridge; U.S. Pat. No. 3,939,395 to Prestridge; U.S. Pat. No. 4,056,451 to Hodgson; U.S. Pat. No. 4,126,537 to Prestridge; U.S. Pat. No. 4,308,127 to Prestridge; and U.S. Pat. No. 5,861,089 to Gatti et al.

Membranes suitable for use herein may comprise porous inorganic materials, such as alumina, zirconia, titania, silicium carbide, and mixtures thereof. Membranes suitable for use herein may also comprise organic materials such as polytetrafluoroethylene; poly(vinylidene fluoride); polypropylene; polyethylene; cellulose esters; polycarbonate; polysulfone/poly(ether sulfone); polyimide/poly(ether imide); aliphatic polyamide; polyetheretherketone; cross linked polyalkylsiloxane; and mixtures thereof. Suitable membranes are commercially available from Osmonics Inc., Minnetoka, Minn.

Diafiltration is a variation of conventional dialysis in that the rate of microspecies removal is not dependent on concentration but is simply a function of the membrane flux, pressure, and membrane surface area relative to the volume to be exchanged or dialyzed. Repeated or continuous addition of fresh solvent flushes out or exchanges salts and other microspecies efficiently and rapidly.

Extraction is the selective transfer of a compound or compounds from one liquid to another immiscible liquid or from a solid to a liquid. The former process is called a liquid-liquid extraction, wherein a foreign substance, such as an immiscible liquid, is introduced to provide a second phase, to which the compound(s) can preferentially migrate. The driving force is based on the partition coefficient of the solute compound(s) in the respective liquids. In this separation technique, the solute compounds in the two liquid phases are merely separated by an interface (i.e., a chemical barrier), not by a physical barrier.

Extracting fluids suitable for use herein to create a second phase from the lipophilic fluids include, but are not limited to, of water; linear or branched, cyclic or acyclic alcohols; linear or branched, cyclic or acyclic diols; and mixtures thereof.

Crystallization is the process of producing crystals from a vapor, a melt, or a solution and is distinguished from precipitation in that the latter usually exhibits extremely high levels of super-saturation, primary nucleation, and low solubility ratios.

The contaminants can also be removed from the dry cleaning solvent or composition by contacting the mixture with an absorbent material or adsorbent material. The adsorbent or adsorbent materials can be added to the mixture as solid particulates/powders or can be contained in a cartridge or like container. The absorbent materials are effective in preferentially removing water from the mixture of lipophilic fluid and contaminants. Moreover, the lipophilic fluid purified by the pseudo-distillation step can benefit from a post-treatment step by exposing it to adsorbents (such as activated carbon or clay) to remove any residual contaminants that was carried over via the vapors of the lipophilic fluid.

Suitable adsorbent materials include, but are not limited to, activated carbon, clay, a polar agent, an apolar agent, a charged agent, and mixtures thereof.

The polar agent suitable for use as the adsorbent material herein has the formula:

$$(Y_a—O_b)\ X$$

wherein Y is Si, Al, Ti, P; a is an integer from about 1 to about 5; b is an integer from about 1 to about 10; and X is a metal. In one embodiment, the polar agent suitable for use in the adsorbent material of the present invention is selected from the group consisting of: silica, diatomaceous earth, aluminosilicates, polyamide resin, alumina, zeolites and mixtures thereof. Preferably, the polar agent is silica, more specifically silica gel. Suitable polar agents include SIL-FAM® silica gel, available from Nippon Chemical Industries Co., Tokyo, Japan; and Davisil® 646 silica gel, available from W. R. Grace, Columbia, Md.

Apolar agents suitable for use herein as the adsorbent material comprise one or more of the following: polystyrene, polyethylene, and/or divinyl benzene. The apolar agent may be in the form of a fibrous structure, such as a woven or nonwoven web. Suitable apolar agents include Amberlite® XAD-16 and XAD-4, available from Rohm & Haas, Philadelphia, Pa.

The charged agents suitable for use herein are selected from the group consisting of: anionic materials, cationic materials, zwitterionic materials and mixtures thereof. In one embodiment, the charged agent has the formula:

$$(W\text{-}Z)\ T$$

wherein W is Si, Al, Ti, P, or a polymer backbone; Z is a charged substituent group and T is a counterion selected from alkaline, alkaline earth metals and mixtures thereof. For example, T may be: sodium, potassium, ammonium, alkylammonium derivatives, hydrogen ion; chloride, hydroxide, fluoride, iodide, carboxylate, etc. The W portion typically comprises from about 1% to about 15% by weight of the charged agent. The polymer backbone typically comprises a material selected from the group consisting of:

polystryrene, polyethylene, polydivinyl benzene, polyacrylic acid, polyacrylamide, polysaccharide, polyvinyl alcohol, copolymers of these and mixtures thereof. The charged substituent typically comprises sulfonates, phosphates, quaternary ammonium salts and mixtures thereof. The charged substituent may comprise alcohols; diols; salts of carboxylates; salts of primary and secondary amines and mixtures thereof. Suitable charged agents are available from Rohm & Haas, Philadelphi, Pa., under the designation IRC-50.

Suitable absorbent materials include, but are not limited to, hydrogel-forming absorbent materials or absorbent gelling material (AGM), and mixtures with other spacer or matrix materials to prevent gel blocking and/or enhance absorbency.

Hydrogel-forming absorbent polymers are also commonly referred to as "hydrocolloids" and can include polysaccharides such as carboxymethyl starch, carboxymethyl cellulose, and hydroxypropyl cellulose; nonionic types such as polyvinyl alcohol, and polyvinyl ethers; cationic types such as polyvinyl pyridine, polyvinyl morpholinione, and N,N-dimethylaminoethyl or N,N-diethylaminopropyl acrylates and methacrylates, and the respective quaternary salts thereof. The copolymers therof may be partially neutralized, slightly network crosslinked, or both. Typically, hydrogel-forming absorbent polymers have a multiplicity of anionic or cationic functional groups. These polymers can be used either solely or in the form of a mixture of two or more different polymers. Examples of these polymer materials are disclosed in U.S. Pat. Nos. 3,661,875; 4,076,663; 4,093,776; 4,666,983, and 4,734,478.

Other gelling materials are also suitable for use herein as the absorbent materials. Nonlimiting examples of these gels suitable for use herein may be based on acrylamides, acrylates, acrylonitriles, diallylammonium chloride, dialkylammonium chloride, and other monomers. Some suitable gels are disclosed in U.S. Pat. Nos. 4,555,344, 4,828,710, and European Application EP 648,521 A2.

The hydrogel-forming polymer component may also be in the form of a mixed-bed ion-exchange composition comprising a cation-exchange hydrogel-forming absorbent polymer and an anion-exchange hydrogel-forming absorbent polymer. Such mixed-bed ion-exchange compositions are described in, e.g., U.S. patent application Ser. No. 09/130,321, filed Jan. 7, 1998 by Ashraf, et al. (P&G Case 6976R); and U.S. Pat. No. 6,121,509.

The Cleaning System and Apparatus

The present invention also includes a cleaning system and apparatus suitable for use in the method described above. The cleaning system comprises a fabric article treating vessel, a dry cleaning solvent reservoir, and optionally, a sensor for monitoring the contaminant level in the dry cleaning solvent. When contaminants concentration exceeds some pre-determined value, it would indicate that the dry cleaning solvent has reached maximum contaminant holding tolerance and needs to be purified. Additionally, solvent purification/recovery device comprising a pseuso-distillation unit capable of conducting the purification method of the present invention may also be provided as an integral part of the system/apparatus. However, it needs not be. The pseudo-distillation unit can be a stand-alone device, separate from the dry cleaning system.

Any suitable fabric article treating vessel known to those of ordinary skill in the art can be used. The fabric article treating vessel receives and retains a fabric article to be treated during the operation of the cleaning system. In other words, the fabric article treating vessel retains the fabric article while the fabric article is being contacted by the dry cleaning solvent. Nonlimiting examples of suitable fabric article treating vessels include commercial cleaning machines, domestic, in-home, washing machines, and clothes drying machines.

The methods and systems of the present invention may be used in a service, such as a cleaning service, diaper service, uniform cleaning service, or commercial business, such as a Laundromat, dry cleaner, linen service which is part of a hotel, restaurant, convention center, airport, cruise ship, port facility, casino, or may be used in the home.

The methods of the present invention may be performed in an apparatus that is a modified existing apparatus and is retrofitted in such a manner as to conduct the method of the present invention in addition to related methods.

The methods of the present invention may also be performed in an apparatus that is specifically built for conducting the present invention and related methods.

Further, the methods of the present invention may be added to another apparatus as part of a dry cleaning solvent processing system. This would include all the associated plumbing, such as connection to a chemical and water supply, and sewerage for waste wash fluids.

The methods of the present invention may also be performed in an apparatus capable of "dual mode" functions. A "dual mode" apparatus is one capable of both washing and drying fabrics within the same vessel (i.e., drum). These apparatuses are commercially available, particularly in Europe. Additionally, the method of the present invention may also be performed in an apparatus capable of performing "bi-modal" cleaning functions. A "bi-modal" apparatus is one capable of performing both non-aqueous washing and aqueous washing in the same vessel, wherein the two washing modes can be performed in sequential washing cycles or in a combination washing cycle. Additionally, the bi-modal machine is capable of fully drying the clothes without having to transfer them to a separate machine. That is, a machine can have the bi-modal function as well as the dual-mode function.

An apparatus suitable for use in the present invention will typically contain some type of control systems, including electrical systems, such as "smart control systems", as well as more traditional electromechanical systems. The control systems would enable the user to select the size of the fabric load to be cleaned, the type of soiling, the extent of the soiling, the time for the cleaning cycle. Alternatively, the control systems provide for pre-set cleaning and/or refreshing cycles, or for controlling the length of the cycle, based on any number of ascertainable parameters the user programed into the apparatus. For example, when the collection rate of dry cleaning solvent reaches a steady rate, the apparatus could turn its self off after a fixed period of time, or initiate another cycle for the dry cleaning solvent.

In the case of electrical control systems, one option is to make the control device a so-called "smart device", which provides smart functions, such as self diagnostics; load type and cycle selection; Internet links, which allow the user to start the apparatus remotely, inform the user when the apparatus has cleaned a fabric article, or allow the supplier to remotely diagnose problems if the apparatus malfunctioned. Furthermore, if the system of the present invention is only a part of a cleaning system, the so called "smart system" could be communicating with the other cleaning devices which would be used to complete the remainder of the cleaning, such as a washing machine, and a dryer.

Test Method

Thin Layer Chromatography

The percentage of contaminants removed from the lipophilic fluid can determined by Thin Layer Chromatography (TLC).

A vial containing a mixture of 100 grams of a lipophilic liquid and 0.1 grams of an artificial body soil (available from Empirical Manufacturing Company Inc., Cincinnati, Ohio) and 0.1 grams of Neodol 91-2.5 surfactant (available from Shell Chemical Co., Houston, Tex.) is prepared; both the artificial body soil and the surfactant are considered contaminants for the purpose of this test.

A 2 microliters sample is taken from the mixture containing the lipophilic fluid and added contaminants and the mixture after it is purified by the present method; both are analyzed by TLC on Silica Gel G plates (inorganic binder, #01011, 20 cm×20 cm, available from Analtech, Inc. Newark, Del.).

Three developing solvents were used in the TLC analysis: (1) 100% heptane; (2) toluene:hexane at a volume ratio of 160:40; and (3) hexane:diethyl ether:acetic acid at a volume ratio of 160:40:2; all solvents were purchased from Burdick & Jackson. The first solvent system is allowed to migrate up to the top of the TLC plate to the horizontal line (17.5 cm) and typically takes about 30 minutes. The TLC plate is dried for 20 minutes. The second solvent system is allowed to migrate 16.5 cm up the plate and typically takes about 26 minutes. The TLC plate is dried for 30 minutes. The third solvent system is allowed to migrate 9.5 cm up the plate and typically takes about 9 minutes. The TLC plate is dried for 30 minutes. Spray the dried TLC plate evenly with 5-7 milliliters of 25% sulfuric acid and place on a hot plate heated to 250°-260° C. and covered with a ceramic tape. Allow the plate to remain on the hot plate until fully charred (10-30 minutes). The charring time will vary according to the compounds tested. Remove the plate from the hot plate with heated spatulas (to prevent breakage) and place on a glass cloth pad to cool. The charred plated is scanned using Camag Scanner 3 densitometer (from Camag, Switzerland).

A TLC spectrum was measured as area under the curve displayed by the densitometer. The total contaminants removed from the mixture was calculated using formula:

$$MR = S - \left(\frac{A}{B} * S\right)$$

wherein MR=Mass of contaminants removed;

S=Mass of contaminants added to the mixture;

A=TLC area from the mixture purified by the present method; and

B=TLC area from the mixture before the purification process.

All documents cited are, in relevant part, incorporated herein by reference; the citation of any document is not to be construed as an admission that it is prior art with respect to the present invention.

While particular embodiments of the present invention have been illustrated and described, it would be apparent to those skilled in the art that various other changes and modifications can be made without departing from the spirit and scope of the invention. It is therefore intended to cover in the appended claims all such changes and modifications that are within the scope of this invention.

What is claimed is:

1. A purification process for removing contaminants from a lipophilic fluid comprising the steps of:

(a) providing a mixture comprising a lipophilic fluid and at least one contaminant;

(b) converting the mixture into a high surface area fluid having a surface to volume ratio from about 1000:1 to about 4:1;

(c) vaporizing at least the lipophilic fluid in the high surface area fluid from a vaporizing surface while applying a vacuum from about 500 to about 0.5 Torrs, thereby separating the contaminant from the lipophilic fluid and converting the lipophilic fluid into a purified lipophilic fluid; and (d) collecting the purified lipophilic fluid on a condensing surface;

wherein the vaporization process of step (c) is at a steady-state condition; wherein the energy consumption of the process is less than about 0.05 kW-hr per liter of lipophilic fluid processed; and wherein step (c) is maintained at one or more of the following conditions:

(i) a vacuum of about 1 Torr;

(ii) a temperature of 60° C. or less;

(iii) an evaporation rate of lipophilic fluid of about 0.1 to about 100 kg/hr; and (iv) wherein the lipophilic fluid is decamethylcyclopentasiloxane.

2. The process according to claim 1 wherein the high surface area fluid is in a form selected from the group consisting of droplets, thin films, and mixtures thereof.

3. The process according to claim 2 wherein the droplets have an average diameter of from about 0.1 to about 200 microns.

4. The process according to claim 2 wherein the thin film has a thickness of from about 1 to about 1000 microns.

5. The process according to claim 1 wherein the process further comprises a treating step such that the purified lipophilic fluid is further treated by a method selected from the group consisting of chemical modification, liquid-liquid extraction, sedimentation, centrifugation, decantation, filtration, coalescence, air stripping, microbial or enzyme addition, adsorption, absorption, crystallization, precipitation, and combinations thereof.

* * * * *

UNITED STATES PATENT AND TRADEMARK OFFICE

CERTIFICATE OF CORRECTION

PATENT NO. : 7,316,781 B2
APPLICATION NO. : 10/876059
DATED : January 8, 2008
INVENTOR(S) : Radomyselski et al.

It is certified that error appears in the above-identified patent and that said Letters Patent is hereby corrected as shown below:

Column 3
Line 36, delete “immniscible” and insert -- immiscible --.

Signed and Sealed this

Twentieth Day of May, 2008

JON W. DUDAS
*Director of the United States Patent and Trademark Office*